US007110713B2

(12) United States Patent
Cheng

(10) Patent No.: US 7,110,713 B2
(45) Date of Patent: Sep. 19, 2006

(54) SAFETY STRUCTURE FOR A COVER DEVICE

(75) Inventor: Sung-Po Cheng, Hsinchu (TW)

(73) Assignee: Avision Inc., Hsinchu (TW)

( * ) Notice: Subject to any disclaimer, the term of this patent is extended or adjusted under 35 U.S.C. 154(b) by 156 days.

(21) Appl. No.: 10/890,953

(22) Filed: Jul. 14, 2004

(65) Prior Publication Data

US 2005/0025519 A1 Feb. 3, 2005

(30) Foreign Application Priority Data

Jul. 28, 2003 (TW) ..... 92120495 A

(51) Int. Cl.
*G03G 15/00* (2006.01)
*E05F 5/06* (2006.01)
*E05C 19/02* (2006.01)

(52) U.S. Cl. ..... 399/367; 16/85; 292/74; 292/75; 292/127

(58) Field of Classification Search ..... 399/367; 206/278; 16/85; 292/74, 75, 127
See application file for complete search history.

(56) References Cited

U.S. PATENT DOCUMENTS 615,034 A * 11/1898 Merrill ..... 16/85
769,201 A * 9/1904 Blarcom ..... 16/68
941,782 A * 11/1909 Hubbard ..... 292/74
1,329,313 A * 1/1920 Seabury et al. ..... 16/85
1,514,845 A * 11/1924 Fischer ..... 292/75
1,634,349 A * 7/1927 Baruch ..... 16/85
1,730,646 A * 10/1929 Danner ..... 16/85
1,829,916 A * 11/1931 Winans ..... 16/85
1,947,524 A * 2/1934 Horldt ..... 16/85
2,090,945 A * 8/1937 Hofius ..... 16/85
3,751,949 A * 8/1973 Castle ..... 70/144
6,039,388 A * 3/2000 Choi ..... 296/207
6,163,388 A * 12/2000 Lee et al. ..... 358/488
2004/0231099 A1* 11/2004 Li ..... 16/85
2004/0234311 A1* 11/2004 Adams ..... 399/380

FOREIGN PATENT DOCUMENTS

CH 245020 * 10/1946
EP 1555371 A1 * 7/2005
GB 2180297 A * 3/1987
JP 2005-36392 * 2/2005

* cited by examiner

*Primary Examiner*—Daniel J. Colilla
*Assistant Examiner*—Marvin P. Crenshaw

(57) ABSTRACT

A safety structure for a cover device includes a base assembly and a cover assembly. The base assembly has a concave portion. The cover assembly is hinged to the base assembly and may cover the base assembly. The cover assembly has a cover body and a projection, which may elastically protrude out of and retract into the cover body, and may be fit into the concave portion for positioning. The projection is configured such that it may retract into the cover body to prevent an object from being hurt when the cover assembly is placed down and touches the object.

14 Claims, 5 Drawing Sheets

SAFETY STRUCTURE FOR A COVER DEVICE

BACKGROUND OF THE INVENTION

1. Field of the Invention

The invention relates to a safety structure for a cover device, and more particularly to a safety structure for a cover device having a projection.

2. Description of the Related Art

In a conventional computer peripheral such as a scanner, a projection and a concave portion that provide the positioning function are adopted in order to ensure the positioning precision between the cover and the body. At present, the scanner functions are gradually increased with the growing demands of the users. For example, a transparency adaptor may be attached to the cover of the scanner so that the transparency (e.g., film) scan may be performed. Alternatively, an automatic document feeder may be attached to the cover of the scanner so that the sheet-fed scan may be performed. More particularly, a scanning module may be attached to the automatic document feeder so that the duplex sheet-fed scan may be performed.

Hence, the weight of the scanner cover is increased with the addition of the attached assembly/assemblies. When the user places the document on the scanner body and then places the cover down, the projection of the cover together with the concave portion of the body may hurt the human hand therebetween. Alternatively, if the cover drops unexpectedly, the projection may further stab and hurt the human hand.

Because the conventional cover is light-weighted, the projection is directly fixed to the cover or body, and the projection only provides the positioning function without considering the problem of hurting the human hand.

On the other hand, the projection may also cause some botherations in some conditions. For example, when the user places a large-scale document on the scanner, the cover's projection may perforate through the document, or the cover cannot be placed down and cannot flatten the document. It is disadvantageous to this case because the better scan quality can be obtained only if the large-scale document has been flattened.

SUMMARY OF THE INVENTION

It is therefore an object of the invention to provide a safety structure for a cover device, wherein the safety structure has a projection that may be fit into a concave portion so as to protect an object between the projection and the concave portion from being hurt.

To achieve the above-mentioned object, the invention provides a safety structure for a cover device, which includes a base assembly and a cover assembly. The base assembly has a concave portion. The cover assembly is hinged to the base assembly and may cover the base assembly. The cover assembly has a cover body and a projection, which may elastically protrude out of and retract into the cover body, and may be fit into the concave portion for positioning. The projection is configured such that it may retract into the cover body to prevent an object from being hurt when the cover assembly is placed down and touches the object.

The base assembly may include a scanning module for scanning a document, and the cover assembly may include an automatic document feeder for feeding the document or a transparency adaptor for outputting a plane light source.

According to the above-mentioned structure, it is possible to effectively prevent the too-heavy cover assembly from hurting the human hand when it is placed down.

DETAILED DESCRIPTION OF THE INVENTION

Figure 1:
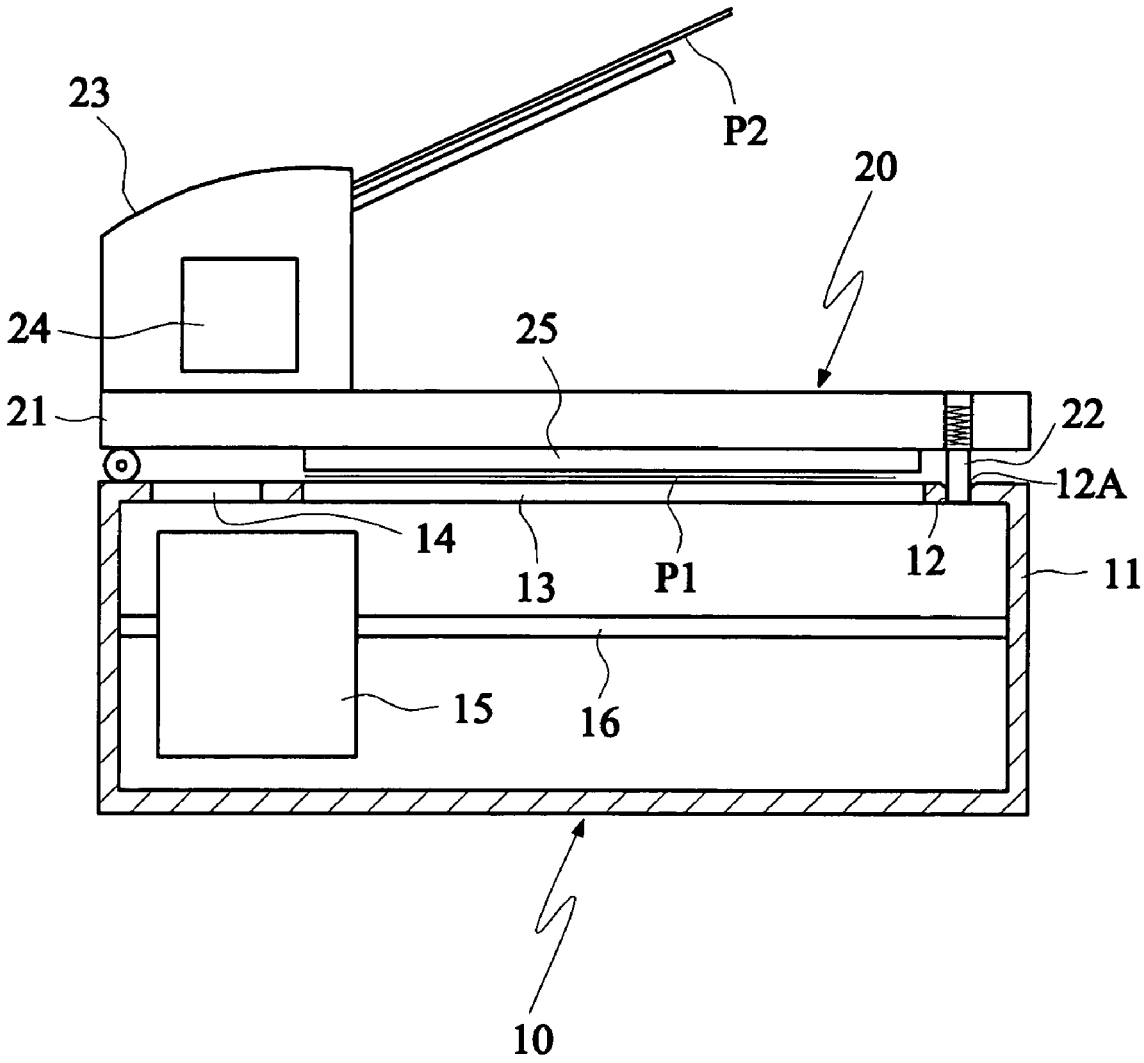
FIG. 1 is a schematic illustration showing a safety structure for a cover device according to a first embodiment of the invention.

FIG. 1 is a schematic illustration showing a safety structure for a cover device according to a first embodiment of the invention. Referring to FIG. 1, the safety structure of this embodiment includes a base assembly 10 and a cover assembly 20. The base assembly 10 includes a base body 11, a first glass window 13, a second glass window 14, a first scanning module 15 and a guiding rod 16. The base body 11 is formed with a concave portion 12, which is formed with a guiding structure 12A. A first document P1 may be placed on the first glass window 13. The first scanning module 15 is movably disposed under the first glass window 13 in order to scan the first document P1.

The cover assembly 20 is hinged to the base assembly 10 and may cover the base assembly 10. The cover assembly 20 includes a cover body 21, a projection 22, an automatic document feeder 23, a second scanning module 24, and a transparency adaptor 25.

The second scanning module 24 is disposed in the automatic document feeder 23 and is for feeding, one by one, a plurality of second documents P2 across the second glass window 14 of the base assembly 10. The first scanning module 15 may further move to a position under the second glass window 14 along the guiding rod 16 so as to scan the second documents P2. The projection 22 may elastically protrude out of and retract into the cover body 21, and may be fit into the guiding structure 12A for positioning along the concave portion 12. When the cover assembly 20 is placed down or drops down to touch an object such as a human hand, the projection 22 may retract into the cover body 21 so as to prevent the object from being hurt. The first glass window 13 and the second glass window 14 may be integrally formed into a one-piece molded structure, or may be separate structures.

The transparency adaptor 25 may output a plane light source to illuminate the first document P1 for the purpose of transparency scan. Although the safety structure of this embodiment includes the automatic document feeder 23, the second scanning module 24, and the transparency adaptor 25, these are not the necessary elements. In another embodiment which does not need the transparency scan, the transparency adaptor 25 also may be removed and replaced by a sheet-pressing component. In still another embodiment which does not need the automatic sheet-feeding function, the automatic document feeder 23 and the second scanning module 24 also may be removed. In yet still another embodiment which does not need the duplex scan function, the second scanning module 24 also may be removed.

Figure 2:
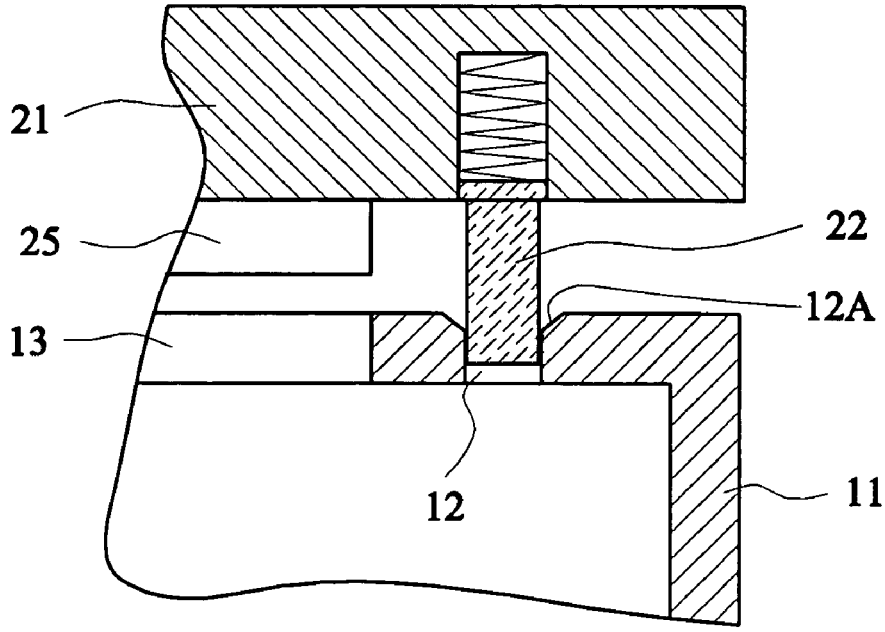
FIG. 2 is a partially enlarged schematic illustration showing the concave portion and the projection of FIG. 1.

FIG. 2 is a partially enlarged schematic illustration showing the concave portion and the projection of FIG. 1. As shown in FIG. 2, when the cover assembly 20 normally covers the base assembly 10, the projection 22 may be inserted into the concave portion 12 just along the guiding structure 12A so as to achieve the positioning function.

Figure 3:
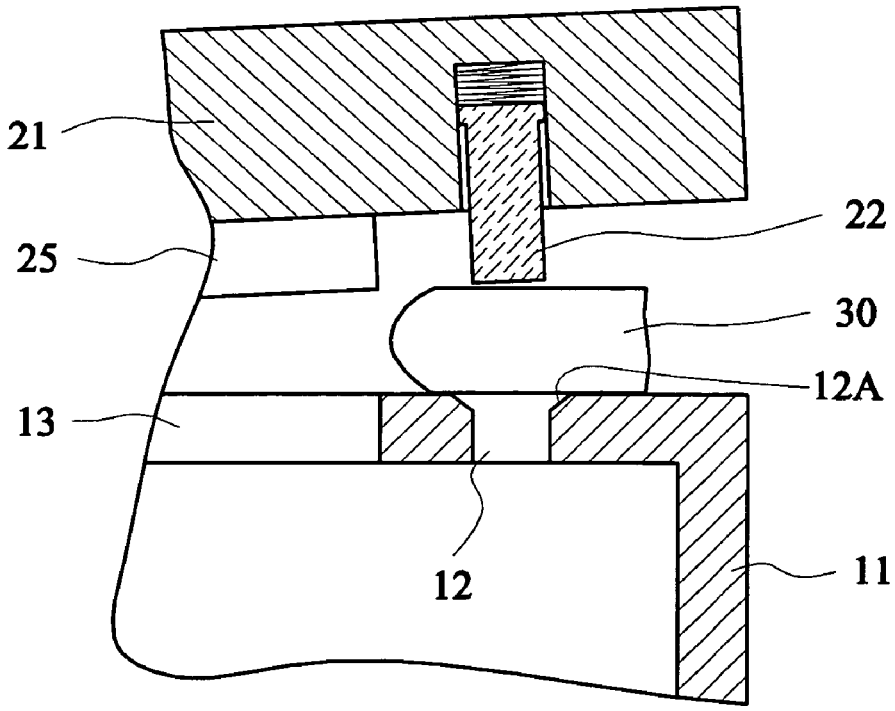
FIG. 3 is another partially enlarged schematic illustration showing the concave portion and the projection of FIG. 1.

FIG. 3 is another partially enlarged schematic illustration showing the concave portion and the projection of FIG. 1. As shown in FIG. 3, when an object 30 such as a human hand exists between the cover assembly 20 and the base assembly 10, the projection 22 may retract into the cover body 21 so as to prevent the heavy cover assembly 20 from hurting the human hand. Alternatively, when the user places a large-scale document, the projection 22 may retract into the cover body 21 so that the cover body 21 may flatten the document.

Figure 4:
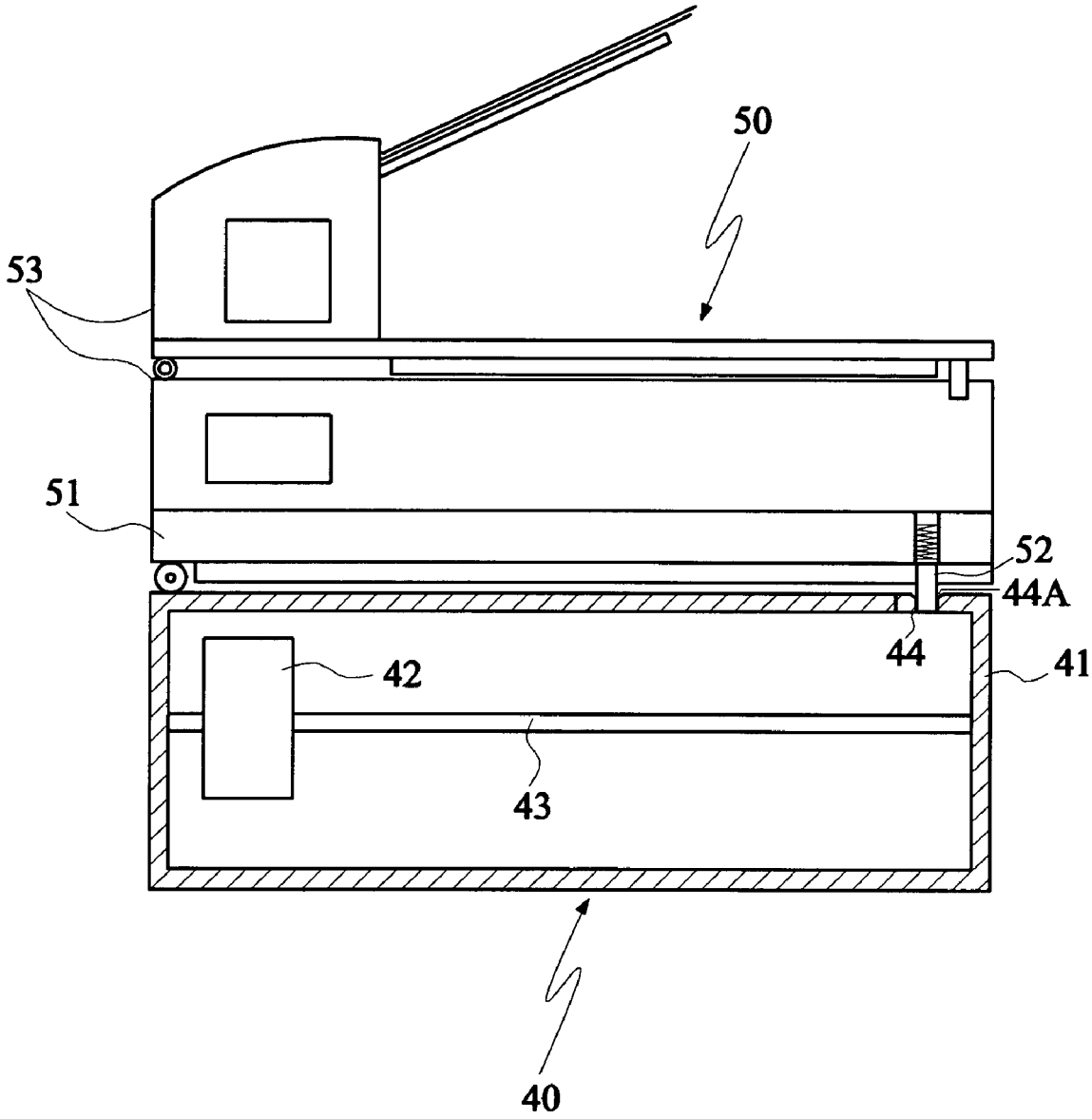
FIG. 4 is a schematic illustration showing a safety structure for a cover device according to a second embodiment of the invention.

FIG. 4 is a schematic illustration showing a safety structure for a cover device according to a second embodiment of the invention. Referring to FIG. 4, the safety structure for the cover device of this embodiment includes a base assembly 40 and a cover assembly 50.

The base assembly 40 includes a base body 41, a printer module 42 and a guiding rod 43. The base body 41 is formed with a concave portion 44, which is formed with a guiding structure 44A. The printer module 42, which may be an inkjet print head or a dot-matrix type print head, may move or be moved back and forth along the guiding rod 43 so as to print a sheet. In other embodiments, the printer module 42 also may be a printer module suitable for the laser printer.

The cover assembly 50 is hinged to the base assembly 40 and may cover the base assembly 40. The cover assembly 50 includes a cover body 51, a projection 52 and a scanning device 53. The scanning device 53 is for scanning a document and outputting a printing signal, which corresponds to the document, to the printer module 42 for printing. The scanning device 53 is similar to the overall structure of FIG. 1, and detailed descriptions thereof will be omitted. Because the cover assembly 50 carries the scanning device 53, the cover assembly 50 is very heavy. According to the design of the invention, it is possible to effectively prevent the concave portion and projection for positioning from hurting the object.

Figure 5:
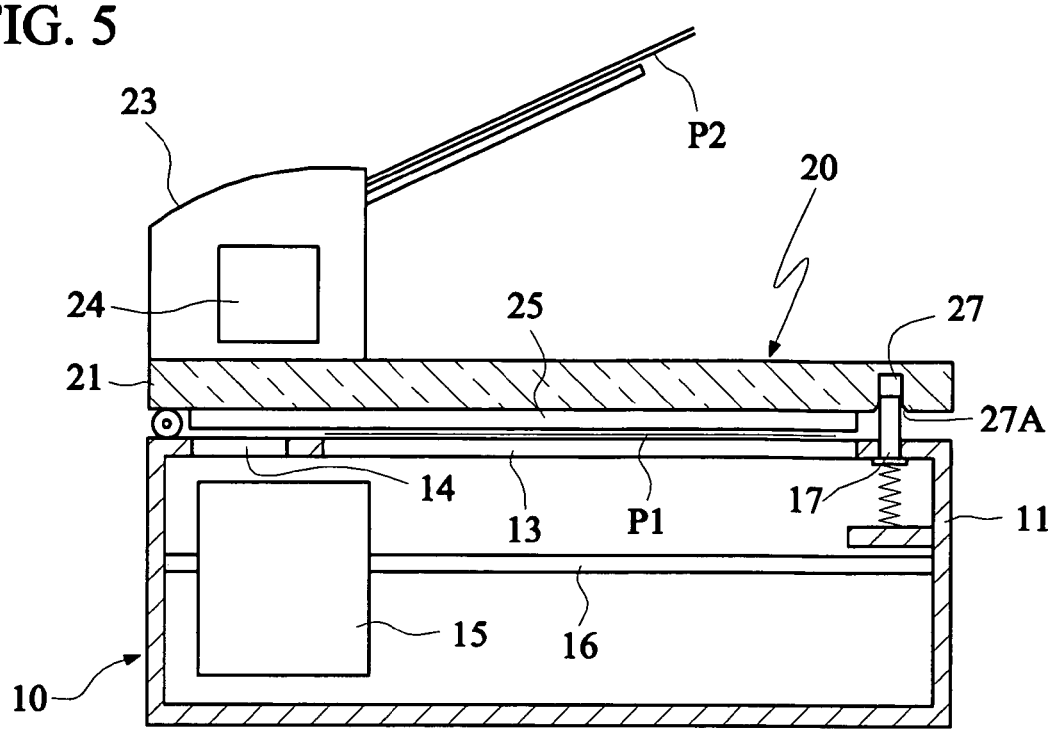
FIG. 5 is a schematic illustration showing a safety structure for a cover device according to a third embodiment of the invention.

FIG. 5 is a schematic illustration showing a safety structure for a cover device according to a third embodiment of the invention. Referring to FIG. 5, the safety structure of this embodiment includes a base assembly 10 and a cover assembly 20. The base assembly 10 includes a base body 11, a first glass window 13, a second glass window 14, a first scanning module 15 and a guiding rod 16. The base assembly 10 has a projection 17 which may elastically protrude out of and retract into the base body 11. A first document P1 may be placed on the first glass window 13. The first scanning module 15 is movably disposed under the first glass window 13 so as to scan the first document P1.

The cover assembly 20 is hinged to the base assembly 10 and may cover the base assembly 10. The cover assembly 20 includes a cover body 21, a concave portion 27, an automatic document feeder 23, a second scanning module 24 and a transparency adaptor 25. The concave portion 27 is formed with a guiding structure 27A for guiding the projection 17 to the concave portion 27.

The second scanning module 24 is disposed in the automatic document feeder 23 and is for feeding, one by one, a plurality of second documents P2 across the second glass window 14 of the base assembly 10. The first scanning module 15 for scanning the second documents P2 may further move or be moved to a position under the second glass window 14 along the guiding rod 16. The projection 17 may elastically protrude out of and retract into the base body 11 and may be fit into the concave portion 27 for positioning along the guiding structure 27A. When the cover assembly 20 is placed down and touches an object such as the human hand, the projection 17 may retract into the base body 11 to prevent the object from being hurt. The first glass window 13 and the second glass window 14 may be integrally formed into a one-piece molded structure, or may be separate structures.

The transparency adaptor 25 may output a plane light source to illuminate the first document P1 for the purpose of transparency scan. It is to be noted that the automatic document feeder 23, the second scanning module 24 and the transparency adaptor 25 may be removed in other embodiments, as mentioned above.

Figure 6:
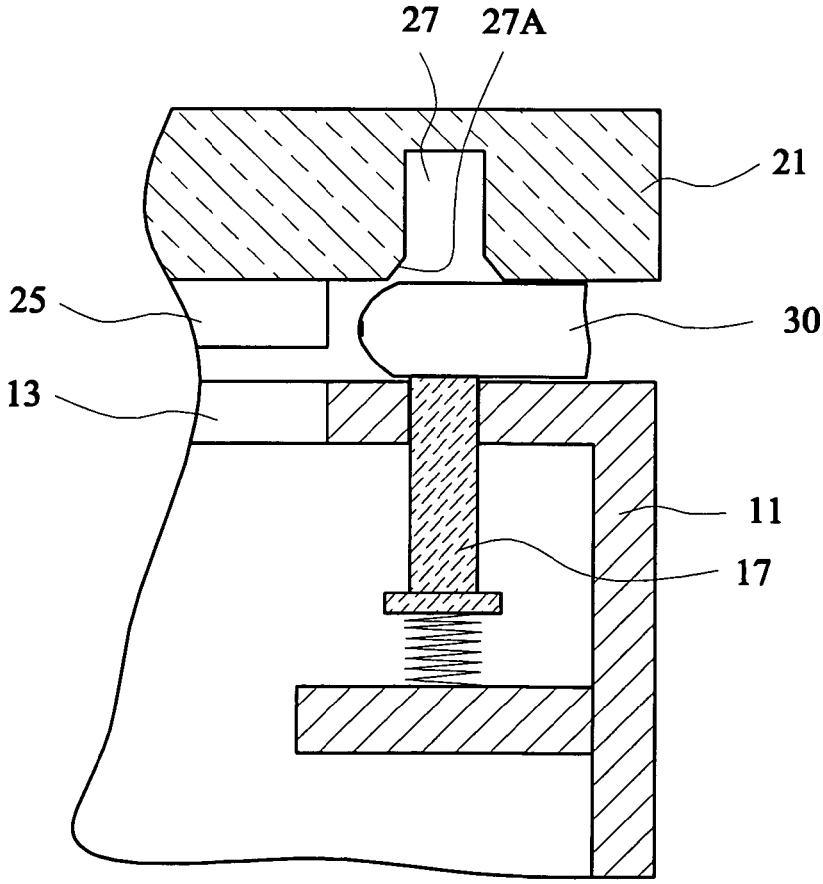
FIG. 6 is a partially enlarged schematic illustration showing the concave portion and the projection of FIG. 5.

FIG. 6 is a partially enlarged schematic illustration showing the concave portion and the projection of FIG. 5. As shown in FIG. 6, when the object 30 such as the human hand exists between the cover assembly 20 and the base assembly 10, the projection 17 may retract into the base body 11 so as to prevent the heavy cover assembly 20 from hurting the hand. Alternatively, when the user places a large-scale document, the projection 17 may retract into the base body 11 so that the cover body 21 may flatten the document.

Figure 7:
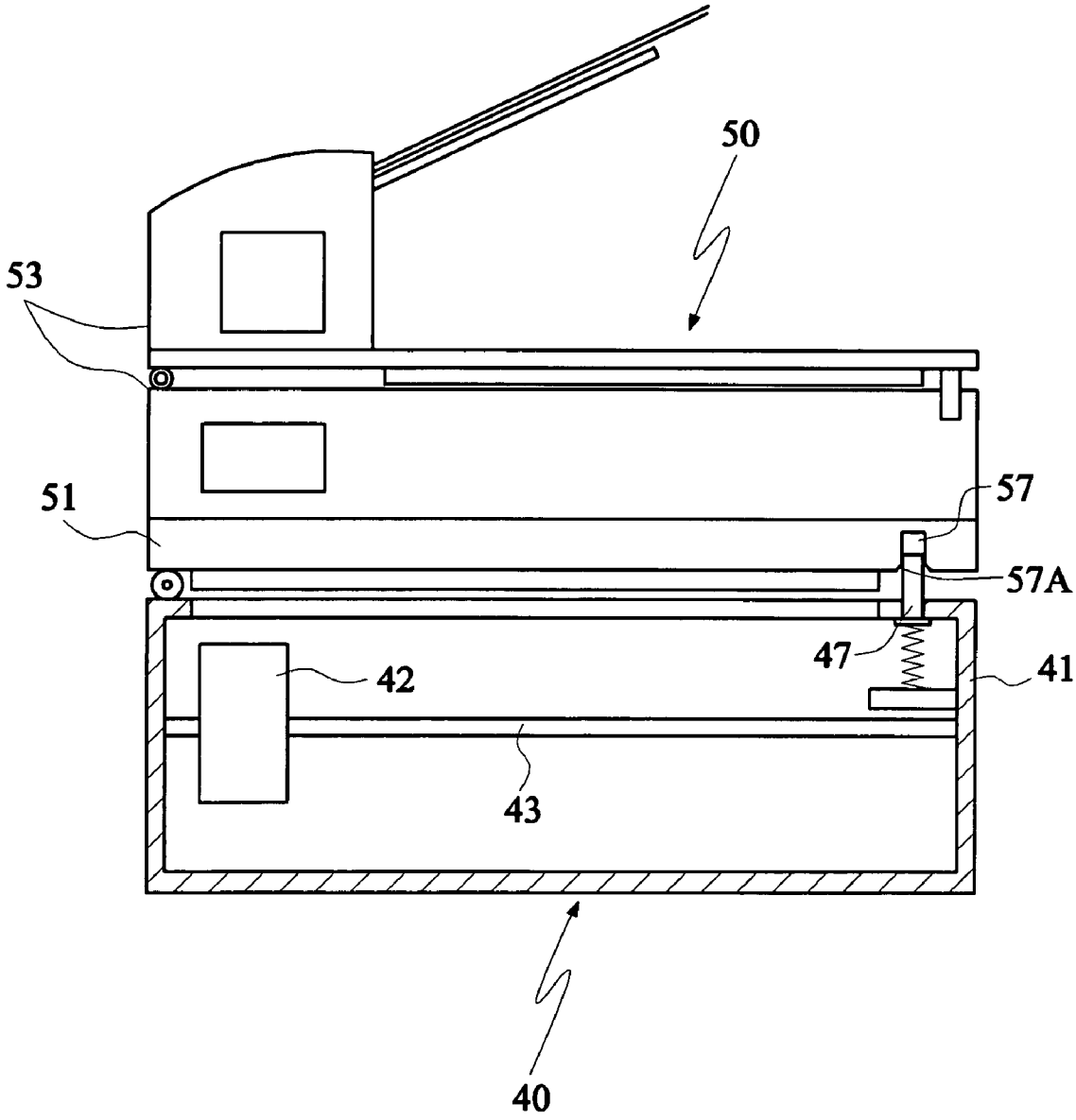
FIG. 7 is a schematic illustration showing a safety structure for a cover device according to a fourth embodiment of the invention.

FIG. 7 is a schematic illustration showing a safety structure for a cover device according to a fourth embodiment of the invention. As shown in FIG. 7, the safety structure of this embodiment includes a base assembly 40 and a cover assembly 50.

The base assembly 40 includes a base body 41, a printer module 42 and a guiding rod 43. The base body 41 is formed with a projection 47. The printer module 42, which may be an inkjet print head or a dot-matrix type print head, may move or be moved back and forth along the guiding rod 43 so as to print a sheet. In other embodiments, the printer module 42 also may be a printer module suitable for the laser printer.

The cover assembly 50 is hinged to the base assembly 40 and may cover the base assembly 40. The cover assembly 50 includes a cover body 51, a concave portion 57 and a scanning device 53. The concave portion 57 is formed with a guiding structure 57A. The scanning device 53 scans a document and outputs a printing signal, which corresponds to the document, to the printer module 42 for printing. The scanning device 53 is similar to the overall structure of FIG. 1 or 5, and detailed descriptions thereof will be omitted. Because the cover assembly 50 carries the scanning device 53, the cover assembly 50 is very heavy. According to the design of the invention, it is possible to effectively prevent the concave portion and projection for positioning from hurting the object.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. A safety structure for a cover device, the safety structure comprising:

a base assembly having a concave portion; and a cover assembly hinged to the base assembly, wherein the cover assembly may cover the base assembly, and has a cover body and a projection, the projection may elastically protrude out of and retract into the cover body, and may be fit into the concave portion for positioning, and the projection is configured such that it may retract into the cover body to prevent an object from being hurt when the cover assembly is placed down and touches the object, wherein the base assembly comprises:

a first glass window on which a first document may be placed; and a first scanning module, which is movably disposed under the first glass window, for scanning the first document.

2. The safety structure according to claim 1, wherein the cover assembly comprises:

an automatic document feeder for feeding, one by one, a plurality of second documents across a second glass window of the base assembly, and the first scanning module under the second glass window further scans the second documents.

3. The safety structure according to claim 2, wherein the first glass window and the second glass window are integrally formed into a one-piece molded structure.

4. The safety structure according to claim 1, wherein the cover assembly comprises:

a transparency adaptor for outputting a plane light source to illuminate the first document for the purpose of transparency scan.

5. A safety structure for a cover device, the safety structure comprising:

a base assembly having a concave portion; and a cover assembly hinged to the base assembly, wherein the cover assembly may cover the base assembly, and has a cover body and a projection, the projection may elastically protrude out of and retract into the cover body, and may be fit into the concave portion for positioning, and the projection is configured such that it may retract into the cover body to prevent an object from being hurt when the cover assembly is placed down and touches the object, wherein the base assembly comprises:

a printer module for printing a sheet.

6. The safety structure according to claim 5, wherein the cover assembly comprises:

a scanning device for scanning a first document and outputting a printing signal, which corresponds to the first document, to the printer module for printing.

7. The safety structure according to claim 5, wherein the concave portion is formed with a guiding structure for guiding the projection to the concave portion.

8. A safety structure for a cover device, the safety structure comprising:

a base assembly having a base body and a projection which may elastically protrude out of and retract into the base body; and a cover assembly, which is hinged to the base assembly, may cover the base assembly, and has a cover body and a concave portion, wherein the concave portion may be fit onto the projection for positioning, and the projection is configured such that it may retract into the base body to prevent an object from being hurt when the cover assembly is placed down and touches the object, wherein the base assembly comprises:

a first glass window on which a first document may be placed; and a first scanning module, which is movably disposed under the first glass window, for scanning the first document.

9. The safety structure according to claim 8, wherein the cover assembly comprises:

an automatic document feeder for feeding, one by one, a plurality of second documents across a second glass window of the base assembly, and the first scanning module under the second glass window further scans the second documents.

10. The safety structure according to claim 9, wherein the first glass window and the second glass window are integrally formed into a one-piece molded structure.

11. The safety structure according to claim 8, wherein the cover assembly comprises:

a transparency adaptor for outputting a plane light source to illuminate the first document for the purpose of transparency scan.

12. A safety structure for a cover device, the safety structure comprising:

a base assembly having a base body and a projection which may elastically protrude out of and retract into the base body; and a cover assembly, which is hinged to the base assembly, may cover the base assembly, and has a cover body and a concave portion, wherein the concave portion may be fit into the projection for positioning, and the projection is configured such that it may retract into the base body to prevent an object from being hurt when the cover assembly is placed down and touches the object, wherein the base assembly comprises:

a printer module for printing a sheet.

13. The safety structure according to claim 12, wherein the cover assembly comprises:

a scanning device for scanning a first document and outputting a printing signal, which corresponds to the first document, to the printer module for printing.

14. The safety structure according to claim 12, wherein the concave portion is formed with a guiding structure for guiding the projection to the concave portion.

* * * * *